US006592506B1

(12) United States Patent
Lyga

(10) Patent No.: US 6,592,506 B1
(45) Date of Patent: Jul. 15, 2003

(54) FOLDER APPARATUS

(75) Inventor: Thomas M. Lyga, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/183,858

(22) Filed: Jun. 25, 2002

(51) Int. Cl.[7] ..... B31F 1/10

(52) U.S. Cl. ..... 493/424; 493/434; 493/442; 493/454

(58) Field of Search ..... 493/424–428, 493/434, 438, 442, 445, 454, 456

(56) References Cited

U.S. PATENT DOCUMENTS 4,493,690 A * 1/1985 Niemiro et al. ..... 493/444
4,643,705 A * 2/1987 Bober ..... 493/444
5,076,556 A 12/1991 Mandel
5,080,340 A * 1/1992 Hacknauer et al. ..... 270/37
5,222,934 A * 6/1993 Ochsner ..... 493/444
5,364,332 A * 11/1994 Gray, Jr. ..... 493/23
5,520,603 A * 5/1996 Bluthardt et al. ..... 493/421
6,024,682 A * 2/2000 Mandel et al. ..... 493/23

* cited by examiner

*Primary Examiner*—Rinaldi I Rada
*Assistant Examiner*—Hemant M. Desai
(74) *Attorney, Agent, or Firm*—Christopher J. Capelli; Angelo N. Chaclas

(57) ABSTRACT

The present invention is directed generally to a folder apparatus for sheets, and more particularly an improved knife folder. In an embodiment, the folder comprises an inducer which is repositionable between a first position and second position, and an idler roller. In the first position the idler roller and a fold roller form a nip. The inducer further comprises a blade adjacent to the idler roller. A first side of the blade and another fold roller define a portion of the feed path adjacent to the another fold roller. When the inducer is in a second position an auxiliary feed path is formed and the sheet may travel along the auxiliary feed path and subsequently be buckled by the blade when the inducer returns to the first position.

9 Claims, 14 Drawing Sheets

FOLDER APPARATUS

FIELD OF THE INVENTION

This invention relates generally to a folder apparatus for folding sheet of material, and more particularly concerns an improved knife folder.

BACKGROUND OF THE INVENTION

In the field of sheet material handling, folders are well known. Oftentimes, it is desirable to place one or more folds in a sheet or a plurality of sheets. Typically, the sheets may be made of paper, plastic, fabric or some other material. The folders have been developed to automate the folding process and thus obtain operational efficiencies over manual methods which tend to be labor intensive, costly and slow. There are two primary methods of generating folds in paper. These are commonly called "buckle folding" and "knife folding". In the mail preparation field, buckle chute folders and knife folders are well known.

Typically, a buckle chute folder comprises two or more fold rollers operating in cooperation with one or more buckle chutes and deflectors to place a sequence of folds in one or more sheets. A conventional buckle chute also includes a stop which is adjustably positioned within the chute for folding the sheets at a particular dimension or distance from the leading edge of the sheet. In operation, a first pair of rollers feeds a stack of sheets (or a single sheet) into the first buckle chute. When the leading edge of the stack hits the stop in the chute, forward progress of the stack ceases. However, the first pair of rollers continue to feed the stack causing a buckle to form in a predetermined location along the length of the stack near the entrance to the buckle chute. As the buckle grows, it enters the nip between another pair of rollers which are positioned adjacent the predetermined location. These rollers fold the stack along the buckle and feed the stack out of the buckle chute. This process is then repeated in subsequent downstream buckle chutes to produce more than one fold in the stack.

Typically, knife folders 1, as shown in FIG. 1*a*, work by registering one or more sheets S adjacent a pair of fold rollers 2, 4 by contacting an edge of the sheet S against a stop 6 and deflecting the sheet S into a fold nip using a moving knife edge bar 8 which is moved in the direction A as shown in FIG. 1*a*.

Buckle chute folders and knife folders are typically used in conjunction with mail processing systems which automatically insert folded sheets into envelopes. Common types of sheet folds are C folds, Z folds shown in FIGS. 1*b* and 1*c* and can be performed using typical folders described above. With the C fold, sheets are folded twice as shown in FIG. 1*b*. With the Z fold, sheets are folded twice in a Z configuration as shown in FIG. 1*c*. A Z fold may be used when an address is desired to be indicated through the window of a window envelope (not shown). Buckle chute folders use a bend in the feed path in order to start a buckle in the sheet that is to be folded.

Typically when a folder is used for various types of folds such as, for example C, Z or half-sheet folds, the folder will need manual adjustments and the sheet will need to be loaded in various configurations in a tray dependent upon the desired fold. Therefore a user or operator would have to make manual mechanical adjustments for each change. Thus, a folder is needed which is easy for a user or operator to use to make various folds.

The addition of a folder to an apparatus such as an inserter typically means that sheets fed through the apparatus will be folded for insertion. However, an operator may want to insert sheets that are not folded. Therefore, it is desirous to have a folder that can be bypassed so that unfolded sheets can be fed. In order to not fold the sheet it is desirous to not have a fixed bend in the feed path.

Thus there is a need for a folder which substantially overcomes the disadvantages and drawbacks associated with the prior art folders. Particularly, there is a need for a folder having the ability to fold various configurations with reduced adjustment. There is also a need for a folder that can be bypassed for flat sheet feeding.

SUMMARY OF THE INVENTION

This invention overcomes the disadvantages of the prior art by providing a folder which can be used to create various folds with reduced mechanical adjustments. The folder can also be bypassed so that an unfolded sheet may be fed downstream. A tray can also be loaded in the same orientation for various folds, allowing an operator to change the application without having to make any manual mechanical adjustments to folder. Thus the folder is easier for the casual operator to use.

This invention relates generally to a folder apparatus for folding sheets of material, and more particularly concerns an improved knife folder. In an embodiment of the present invention, the folder 10 comprises a first fold roller and an input or first idler roller which together define a first nip for feeding a sheet S along an input feed path $F_I$. A second nip is defined by a second fold roller positioned adjacent to the first fold roller. The second nip is configured to feed the sheet along an output or downstream feed path $F_o$. The folder also includes an inducer or knife folder which comprises a movable body repositionable between at least a first position (inducer in) and second position (inducer out), at least one inducer idler roller (second idler roller) attached to the body. In the first position (inducer in), the second idler roller and the second fold roller form a nip.

The inducer further comprises a blade positioned adjacent to the inducer or second idler roller. A first side of the blade and the first fold roller define a portion of the feed path $F_D$ adjacent to the first fold roller when the inducer is in the first position (inducer in). The portion of the feed path $F_D$ helps to deflect the sheet into the nip between the first fold roller and the second fold roller. When the inducer is in a second position (inducer out), an auxiliary feed path $F_a$ is formed and whereby the sheet may travel along the auxiliary feed path $F_a$ and subsequently be buckled by the blade when the inducer returns to the first position (inducer in).

The design of the inducer allows the sheet to be fed from the sheet feeder until it reaches the correct position. The inducer is then actuated to force a buckle into the fold nip. The fold system drives the sheet through the fold system until the loose edge passes the tip of the inducer. The fold system is then reversed and the inducer acts as a guide for the sheet into the upper section of the fold system. The inducer can be retracted (inducer out) and the sheet fed to feed path $F_a$. When in position again, the inducer is actuated again, creating the second fold. The sheet is then driven through the insertion area.

The two fold roller, one inducer system can allow a sheet to be fed from the sheet feeder and up into the clearance path by changing the timing of the inducer to actuate (inducer in) while the sheet is above the fold system. The sheet can then be driven back down and guided by the inducer straight into the fold nip, without creating a fold. This sheet can then be fed through unfolded, into the insertion area, allowing it to be inserted into a flat envelope.

An advantage of the present invention is that it provides a folder which requires less adjustment and which can be bypassed. Another additional advantage of the present invention is that the folder is easier to use by a casual user. Another advantage is that sheets can be placed in trays with the same orientation for various folds. Other advantages of the invention will in part be obvious and will in part be apparent from the specification. The aforementioned advantages are illustrative of the advantages of the various embodiments of the present invention.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1A:
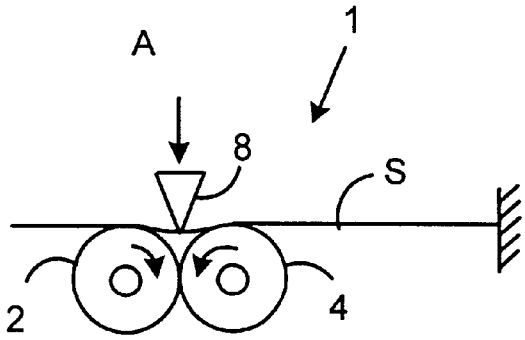
FIG. 1*a* is a simplified side view of a typical prior art knife folder.
Figure 1B:
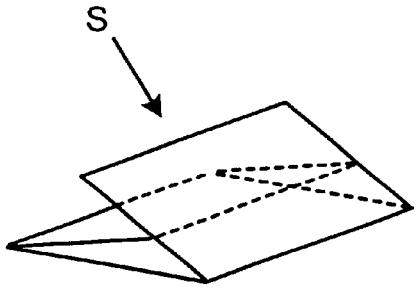
FIG. 1*b* is an isometric view of a C folded sheet.
Figure 1C:
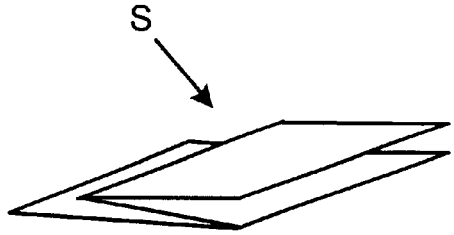
FIG. 1*c* is an isometric view of a Z folded sheet.
Figure 1D:
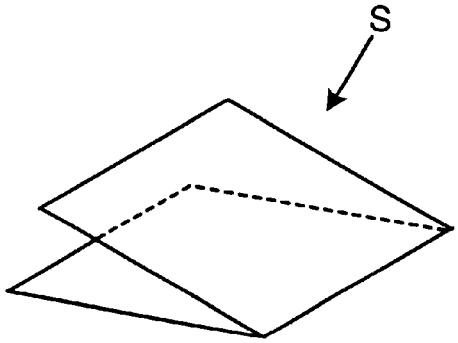
FIG. 1*d* is an isometric view of a half-folded sheet.

In describing the present invention, reference will be made herein to FIGS. 1–6 of the drawings in which like numerals refer to like features of the invention. Features of the invention are not necessarily shown to scale in the drawings. All references cited in this specification, are incorporated by reference herein where appropriate for appropriate teachings of additional or alternative details, features, and/or technical background.

Figure 2:
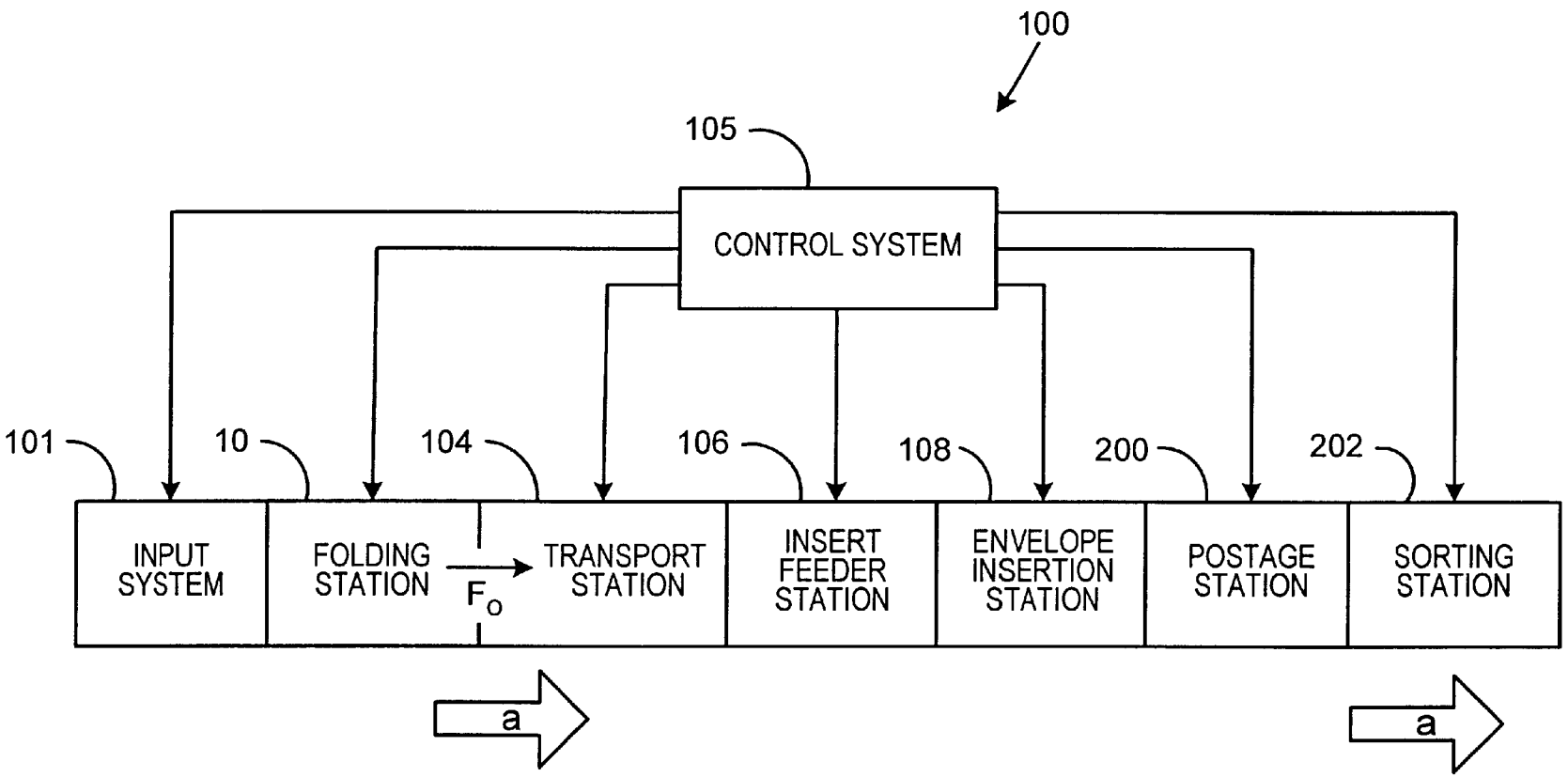
FIG. 2 is a block diagram schematic of a document inserting system in which the present invention folder is incorporated.

FIG. 2 is a schematic of a typical document inserting system, generally designated 100, which implements the present invention input system 118. In the following description, numerous document handling stations implemented in inserter system 100 are set forth to provide a thorough understanding of the operating environment of the folder 10 of the present invention. However it will become apparent to one skilled in the art that the present invention may be practiced without the specific details in regards to each of these document-handling stations.

As will be described in greater detail below, system 100 preferably includes an input system 100 that feeds sheets to an accumulating station that accumulates the sheets into collation packets. Preferably, only a single sheet of a collation is coded (the control document), which coded information enables the control system 105 of inserter system 100 to control the processing of documents in the various stations of the mass mailing inserter system. The code can comprise a bar code, UPC code or the like.

Generally, input system 101 feeds sheets in a feed path, as indicated by arrow "a," along what is commonly termed the "main deck" of inserter system 100. After sheets are accumulated into collations by input system 100, the collations are folded in folding station 10 and the folded collations are then conveyed to a transport station 104, preferably operative to perform buffering operations for maintaining a proper timing scheme for the processing of documents in inserting system 100.

Each sheet collation is fed from transport station 104 to insert feeder station 106. It is to be appreciated that a typical inserter system 100 includes a plurality of feeder stations, but for clarity of illustration only a single insert feeder 106 is shown. Insert feeder station 106 is operational to convey an insert (e.g., an advertisement) from a supply tray to the main deck of inserter system 100 so as to be nested with the aforesaid sheet collation being conveyed along the main deck. The sheet collation, along with the nested insert(s) are next conveyed into an envelope insertion station 108 that is operative to insert the collation into an envelope. The envelope is then preferably conveyed to postage station 200 that applies appropriate postage thereto. Finally, the envelope is preferably conveyed to sorting station 202 that sorts the envelopes in accordance with postal discount requirements.

As previously mentioned, inserter system 100 includes a control system 105 coupled to each modular component of inserter system 100, which control system 105 controls and harmonizes operation of the various modular components implemented in inserter system 100. Preferably, control system 105 uses an Optical Character Reader (OCR) for reading the code from each coded document. Such a control system is well known in the art and since it forms no part of the present invention, it is not described in detail in order not to obscure the present invention. Similarly, since none of the other above-mentioned modular components (namely transport station 104, insert feeder station 106, envelope insertion station 108, postage station 200 and sorting station 202) form no part of the present invention folding station 10, further discussion of each of these stations is also not described in detail in order not to obscure the present invention. Moreover, it is to be appreciated that the depicted embodiment of inserter system 100 implementing the present invention folding station 10 is only to be understood as an example configuration of such an inserter system 100. It is of course to be understood that such an inserter system may have many other configurations in accordance with a specific user's needs.

With respect to the control system, in general the disclosed inserter including the folding device may be readily operated and controlled in a conventional manner with conventional control systems. It is well known in general, and preferable, to program and execute such control functions and logic with conventional software instructions for conventional microprocessors. Such software may vary depending on the particular function and the particular software system and the particular microprocessor or microcomputer system being utilized, but will be available to or readily programmable by those skilled in the applicable arts without from either verbal functional descriptions, such as those provided herein, or prior knowledge of those functions which are conventional, together with general knowledge in the software and computer arts. Controls may alternatively be provided utilizing various other known or suitable hard-wired logic or switching systems.

Figure 3A:
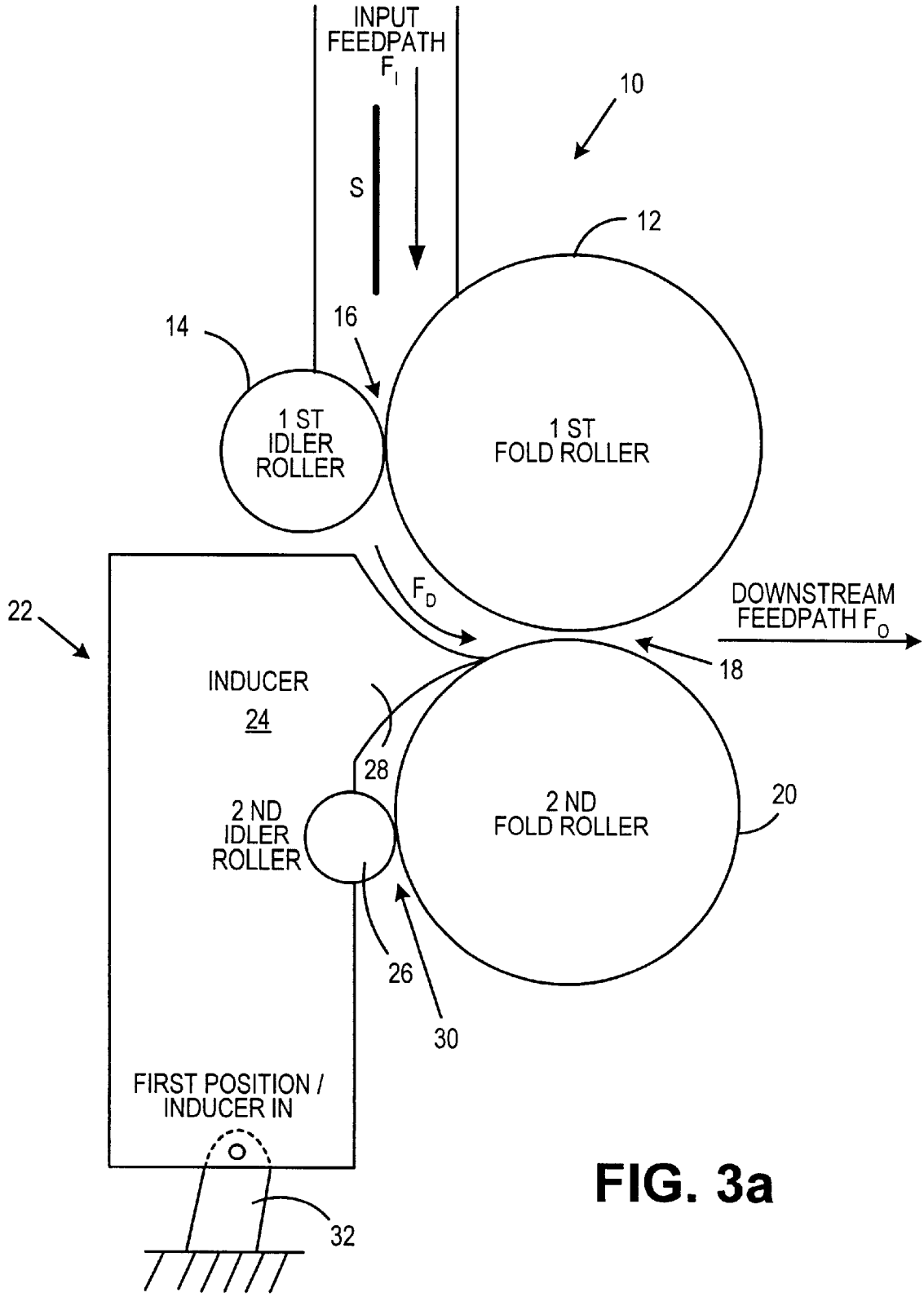
FIG. 3*a* is a simplified illustration of an cross-sectional side view of a folder in a first position in accordance with an embodiment of the folder of the present invention.
Figure 3B:
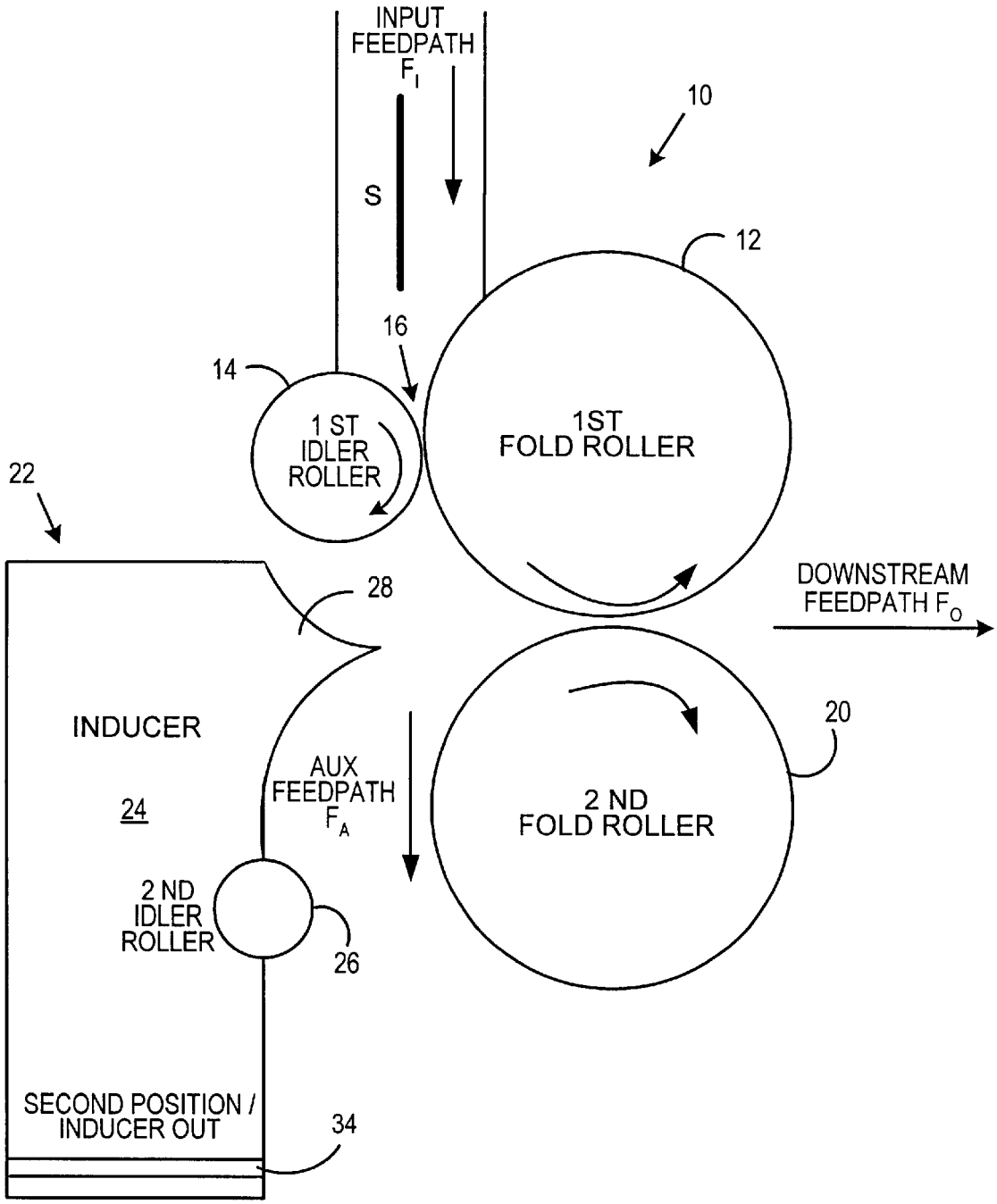
FIG. 3*b* is a simplified illustration of an cross-sectional side view of a folder in a second position in accordance with an embodiment of the folder of the present invention.

FIGS. 3*a* and 3*b* are simplified illustrations of a cross-sectional side view of a folder 10 in accordance with an embodiment of the folder 10 of the present invention. The folder 10 can be used to create various fold configurations to a substrate such as, for example, a sheet S of paper. The various configurations could include those illustrated in FIGS. 1*b*, 1*c* and 1*d*, which represent a C fold, a Z fold and a half-fold, respectively. Other folds, such as double folds, could also be accommodated through the use of timing and motion control as could be determined by one of ordinary skill in the art.

Returning to FIG. 3*a*, the folder 10 comprises a first fold roller 12 and an input or first idler roller 14 which together define a first nip 16 for feeding a sheet S along an input feed path $F_1$. A second nip 18 is defined by a second fold roller 20 positioned adjacent to the first fold roller 12. The second nip 18 is configured to feed the sheet along an output or downstream feed path $F_o$. The folder 10 also includes an inducer or knife folder 22 which comprises a movable body 24 repositionable between at least a first position (inducer in illustrated in FIG. 3*a*) and second position (inducer out illustrated in FIG. 3*b*), at least one inducer idler roller (illustrated in FIGS. 3*a* and 3*b* as second idler roller) 26 attached to the body 24. In the first position (inducer in), illustrated in FIG. 3*a*, the inducer or second idler roller 26 and the second fold roller 20 form a nip 30. In the preferred embodiment, the inducer comprises at least two idler rollers which help the sheet from becoming skewed as it is moved through the nip 30. The inducer 22 further comprises a blade 28 positioned adjacent to the inducer or second idler roller 26. A first side 28*a* of the blade 28 and the first fold roller 12 define a portion of the feed path $F_D$ adjacent to the first fold roller 12 when the inducer is in the first position (inducer in). The portion of the feed path $F_D$ helps to deflect the sheet into the nip 18 between the first fold roller 12 and the second fold roller 20.

As shown in FIG. 3*b*, when the inducer 22 is in a second position (inducer out), shown in FIG. 3*b*) an auxiliary feed path $F_a$ is formed and whereby the sheet may travel along the auxiliary feed path $F_a$ and subsequently be buckled by the blade 28 when the inducer 22 returns to the first position (inducer in). FIG. 3*a* illustrates a pivotable mounting 32 for the inducer 24. In an alternate embodiment, inducer 24 can be mounted on a rail positioned through a void 24 defined by frame 24. The rail would accommodate linear motion of the inducer 24 between the first position and the second position. A control system (not shown) such as a personal computer or microprocessor can be used to control the motion folder 10.

Figure 3C:
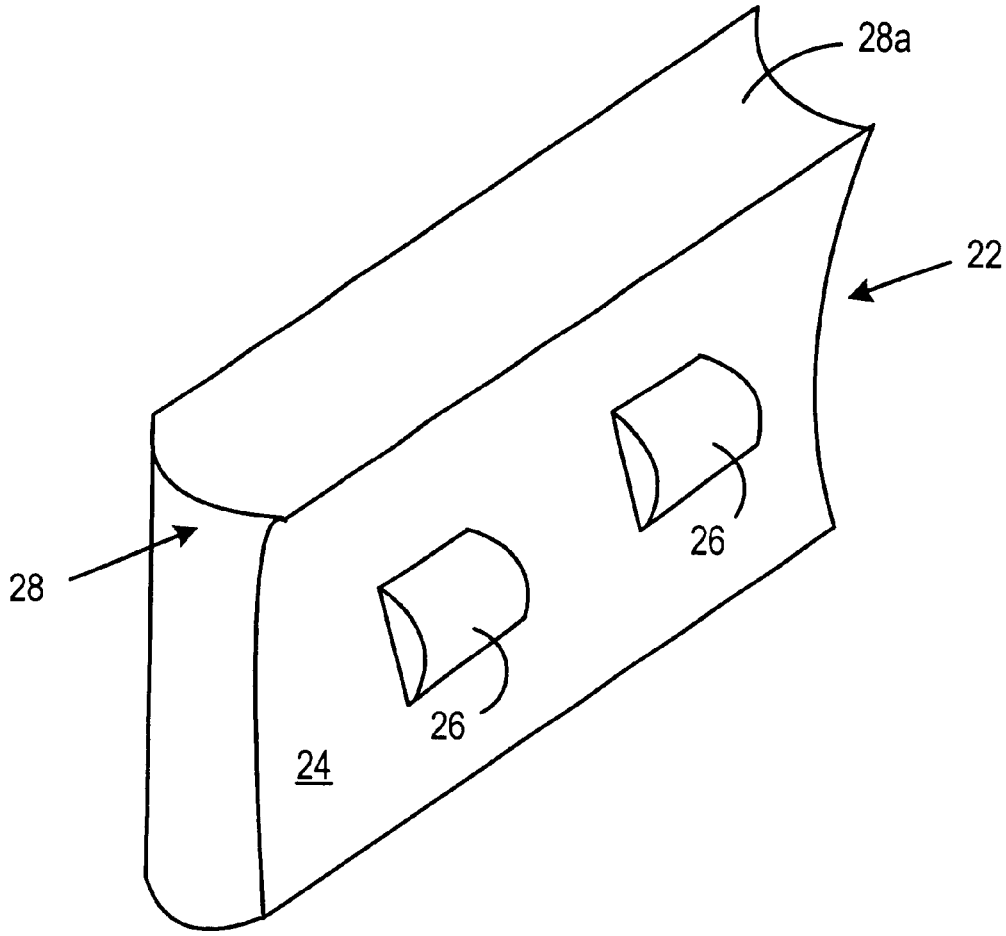
FIG. 3*c* is a perspective view of an embodiment of the inducer of FIGS. 2*a* and 2*b*.

FIG. 3*c* is a perspective view of an embodiment of the inducer of FIGS. 3*a* and 3*b*. In FIG. 3*c* two idler rollers 26 are illustrated however, the number of idler rollers illustrated is not meant to limit the invention include only two idler rollers. One or more idler rollers 26 may be implemented as may be determined by one of ordinary skill in the art. FIG. 3*c* does not illustrate the mounting systems (i.e. pivot and rail) described above. The blade 28 of inducer 22 has a side 28*a* which is used to deflect sheets or the like along feed path $F_D$. As shown in FIG. 3*c*, the fold inducer 22 has two idler rollers 26 that when the inducer 22 is actuated (in) position, create a nip on the lower fold roll. This means that the sheet is now driven evenly from above and below the fold nip. This extra nip provides more control over the sheet being folded and ultimately more reliable, repeatable folds.

Figure 4A:
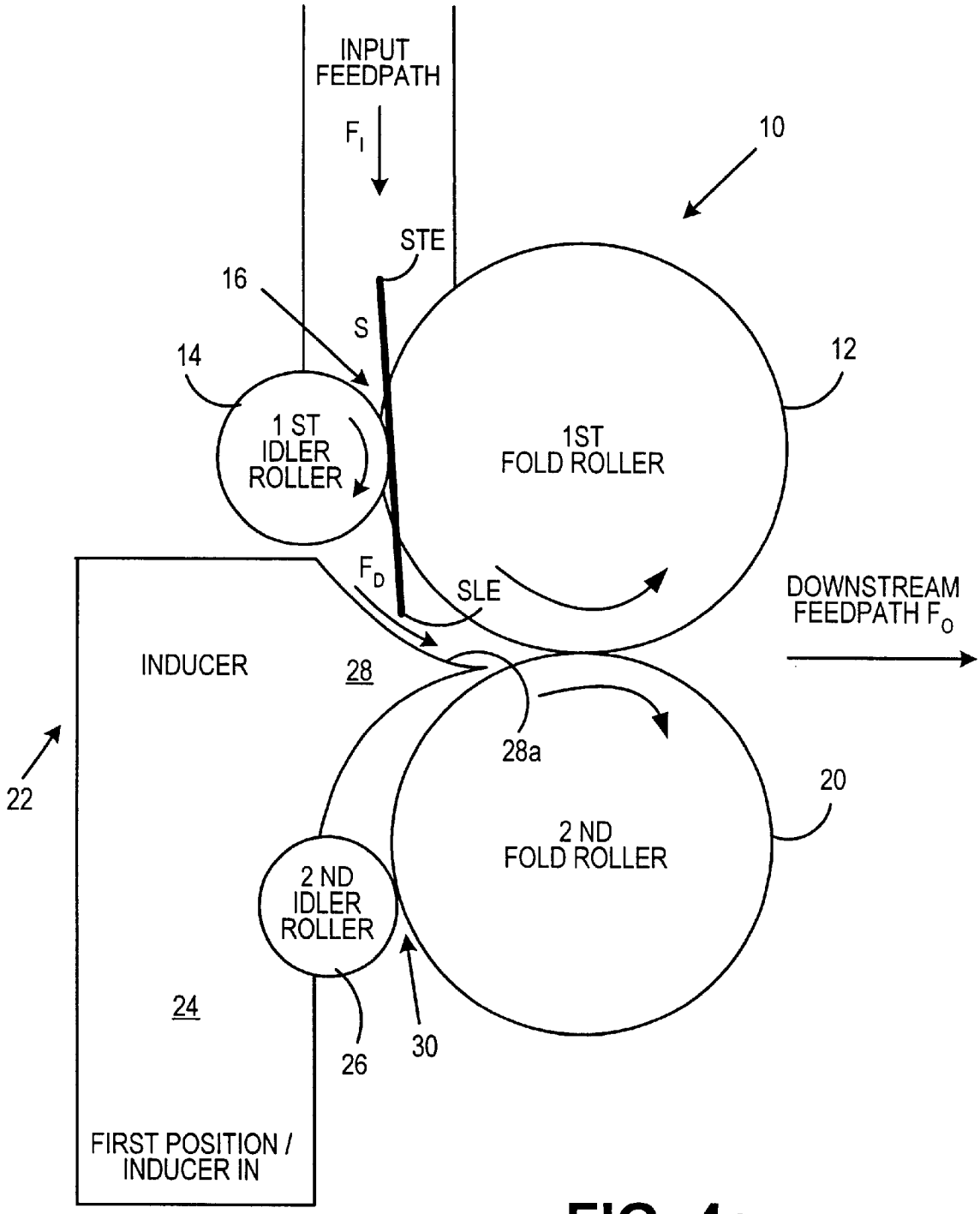
FIGS. 4*a–b* are cross-sectional side views of an embodiment of the present invention illustrating the movement of a sheet through the folder in order to bypass folding and feed the sheet down stream to feed path $F_o$.
Figure 4B:
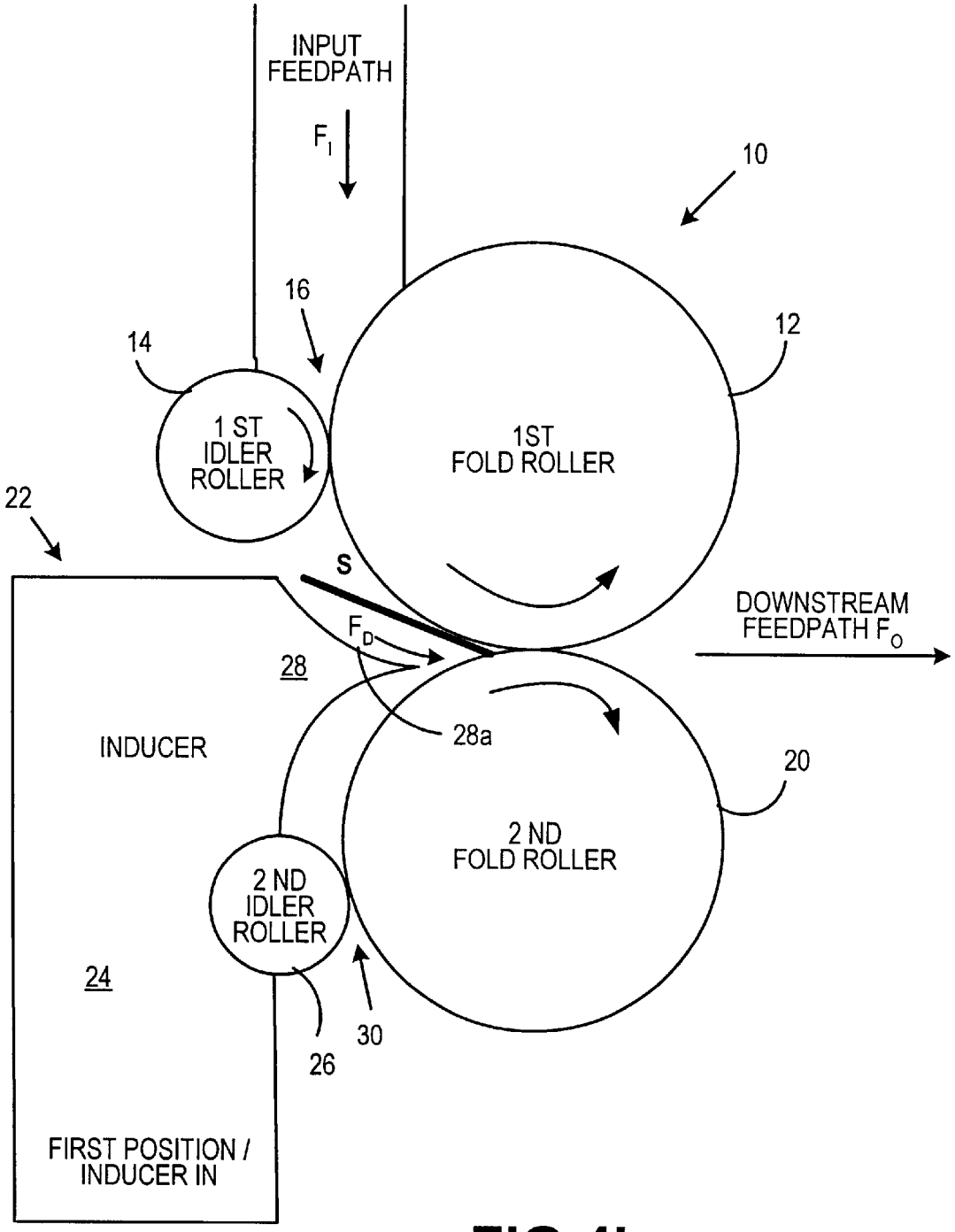

FIGS. 4*a–b* are cross-sectional side views of an embodiment of the present invention illustrating the movement of a sheet through the folder in order to bypass folding and feed the sheet down stream to feed path $F_o$. In both Figures, the inducer is in the first position (inducer in) and the blade is defining feed path $F_D$. FIG. 41 shows the sheet S being moved through nip 16 of rollers 12 and 14. Sheet S has a leading edge $S_{LE}$ and a trailing edge $S_{TE}$. The leading edge $S_{LE}$ is deflected by the side 28*a* of blade 28 and the sheet is moved along feed path $F_D$to the nip 18 of rollers 12 and 20 and moved to feed path $F_o$ shown in FIG. 4*b*.

Figure 5A:
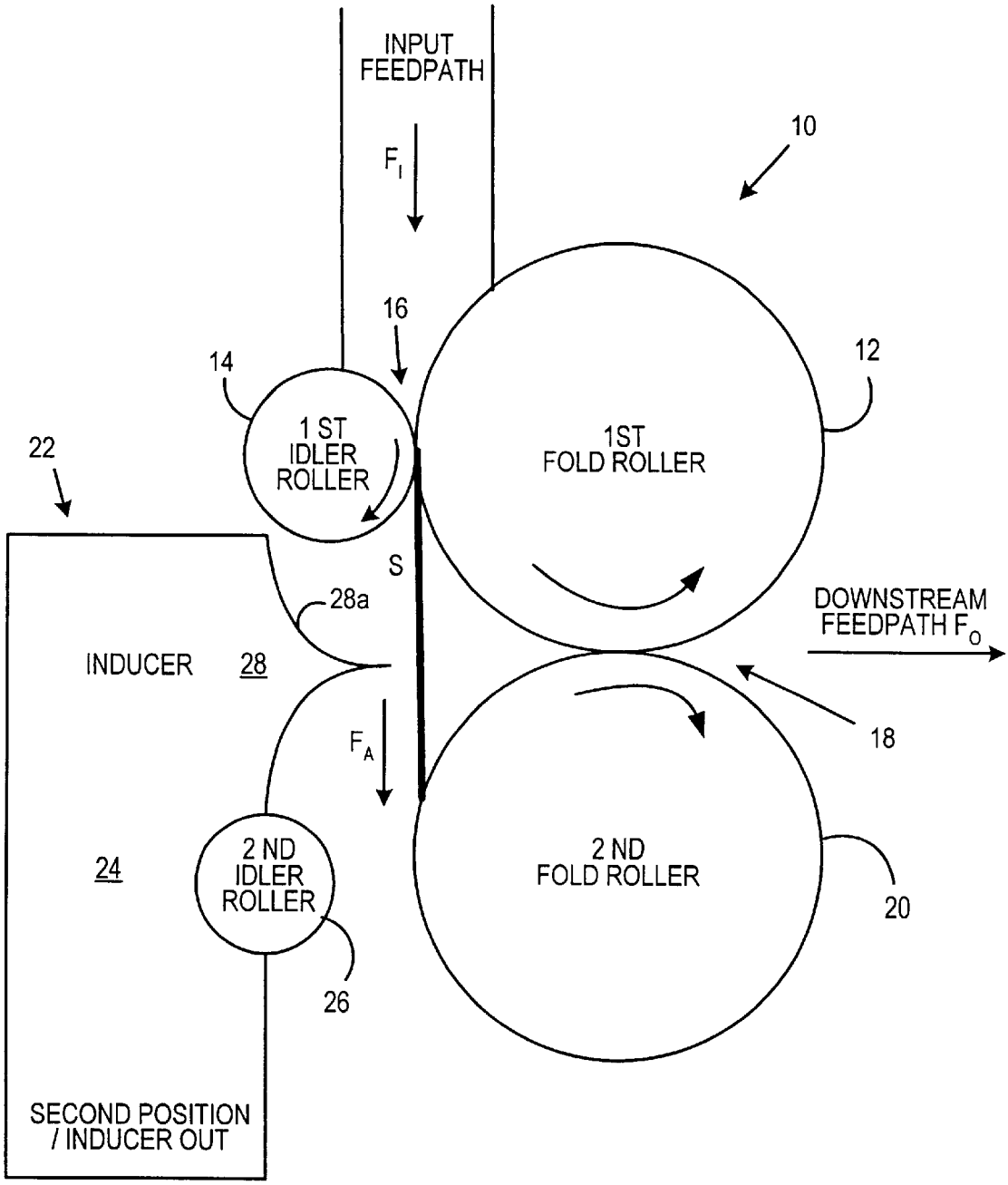
FIGS. 5*a–b* are cross-sectional side views of an embodiment of the present invention illustrating the movement of a sheet through the folder in order to create a half-folded sheet.
Figure 5B:
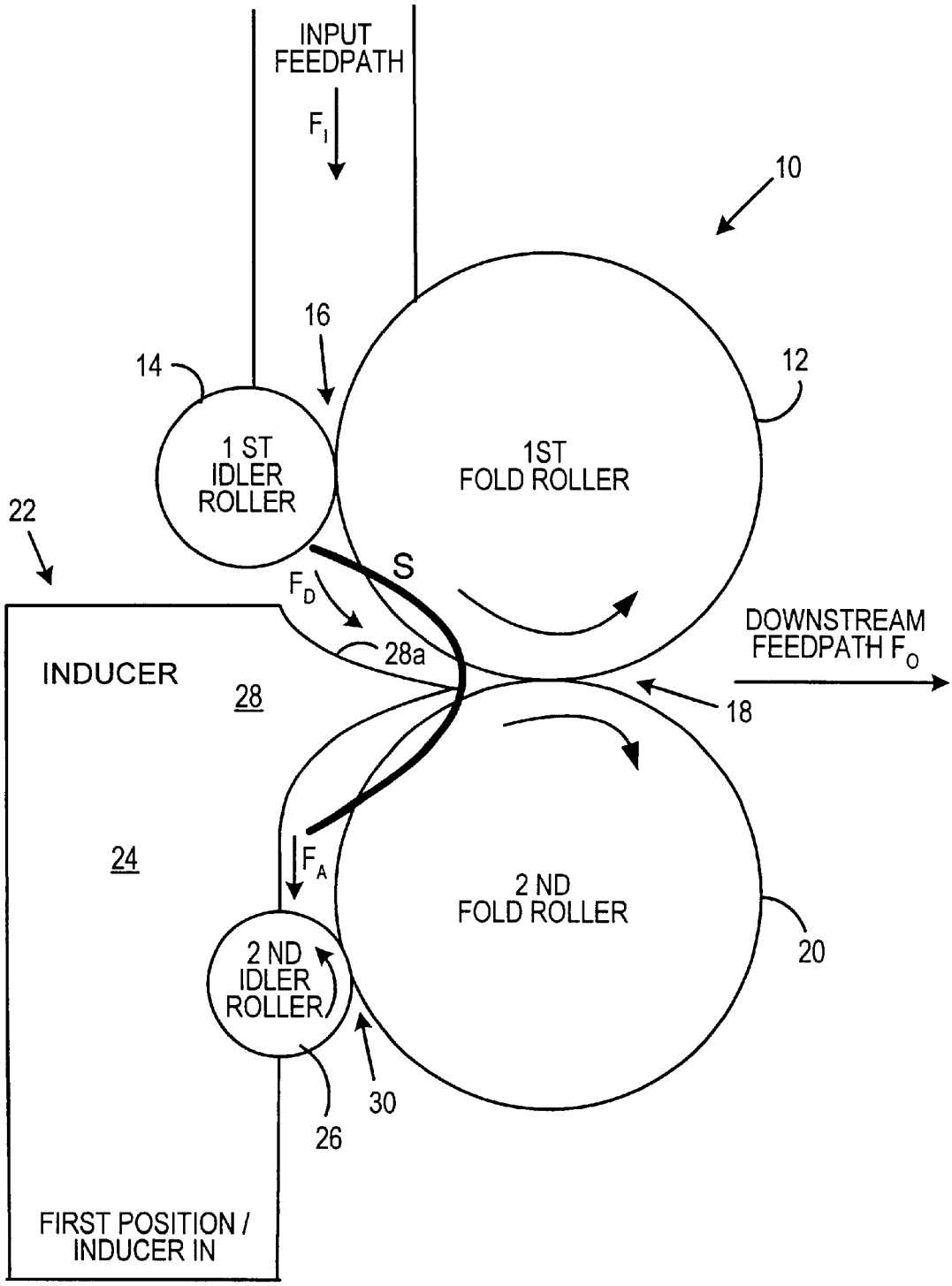

FIGS. 5*a–b* are cross-sectional side views of an embodiment of the present invention illustrating the movement of a sheet through the folder in order to create a half-folded sheet. In FIG. 5*a* the sheet arrives from input feed path $F_I$ to nip 16 of rollers 12 and 14 while the inducer is in the second position (inducer out). In FIG. 5*b*, the inducer is shown in the first position (inducer in) where blade 28 causes a buckle to form in sheet S. Sheet S will next be moved by nip 18 of rollers 12 and 20 to feed path $F_o$.

Figure 6A:
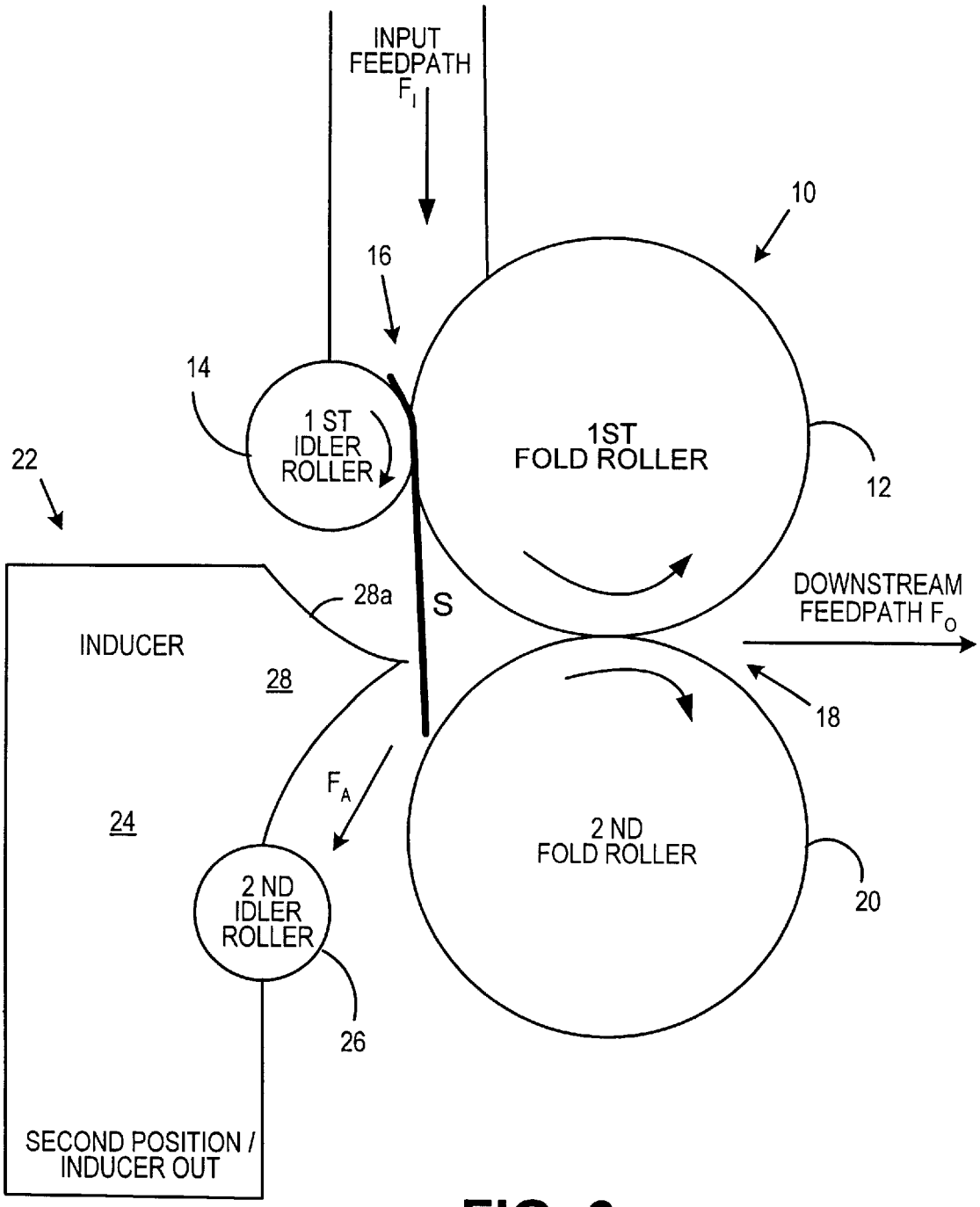
FIGS. 6*a–e* are cross-sectional side views of an embodiment of the present invention illustrating the movement of a sheet through the folder in order to create a C-folded sheet.
Figure 6B:
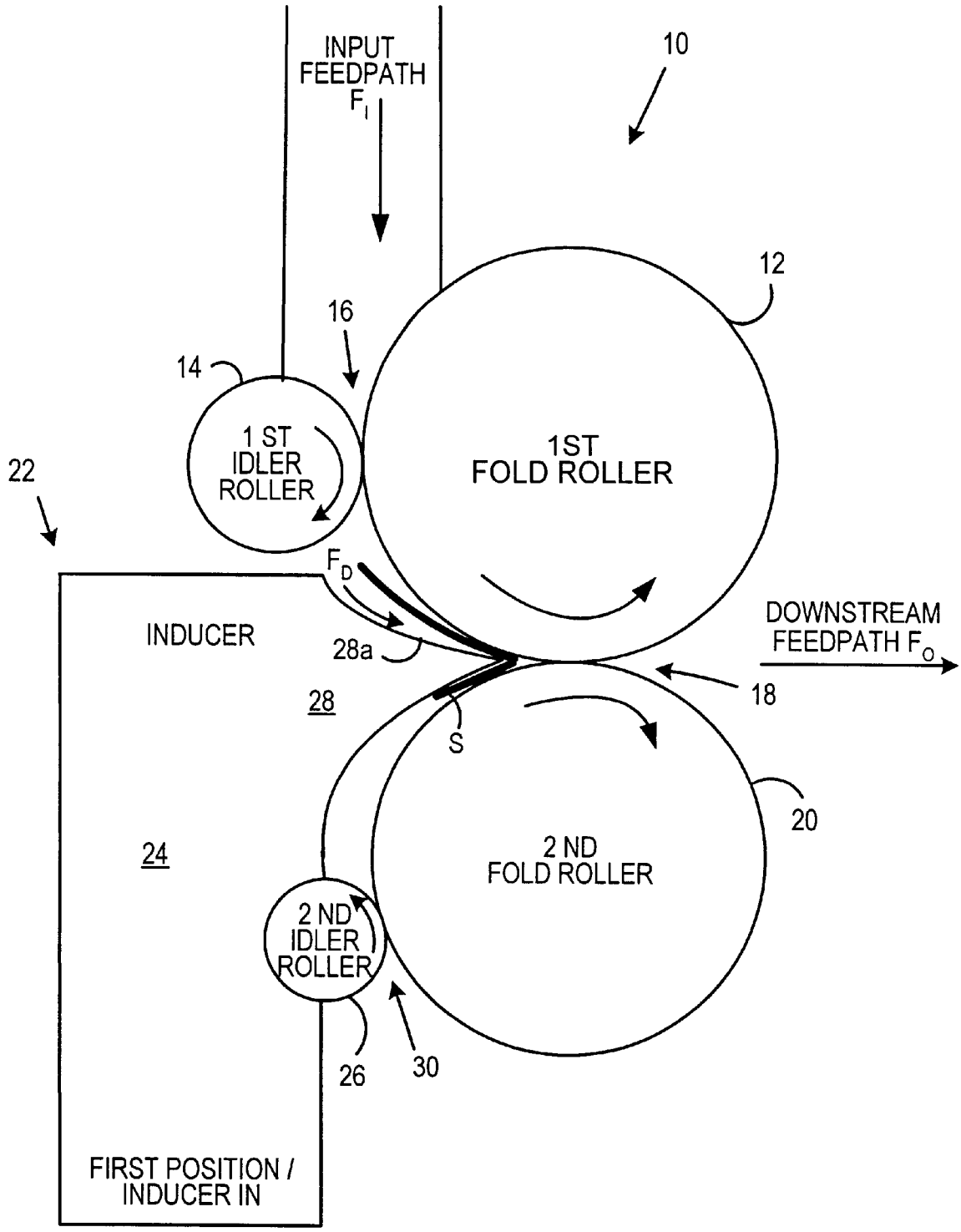
Figure 6C:
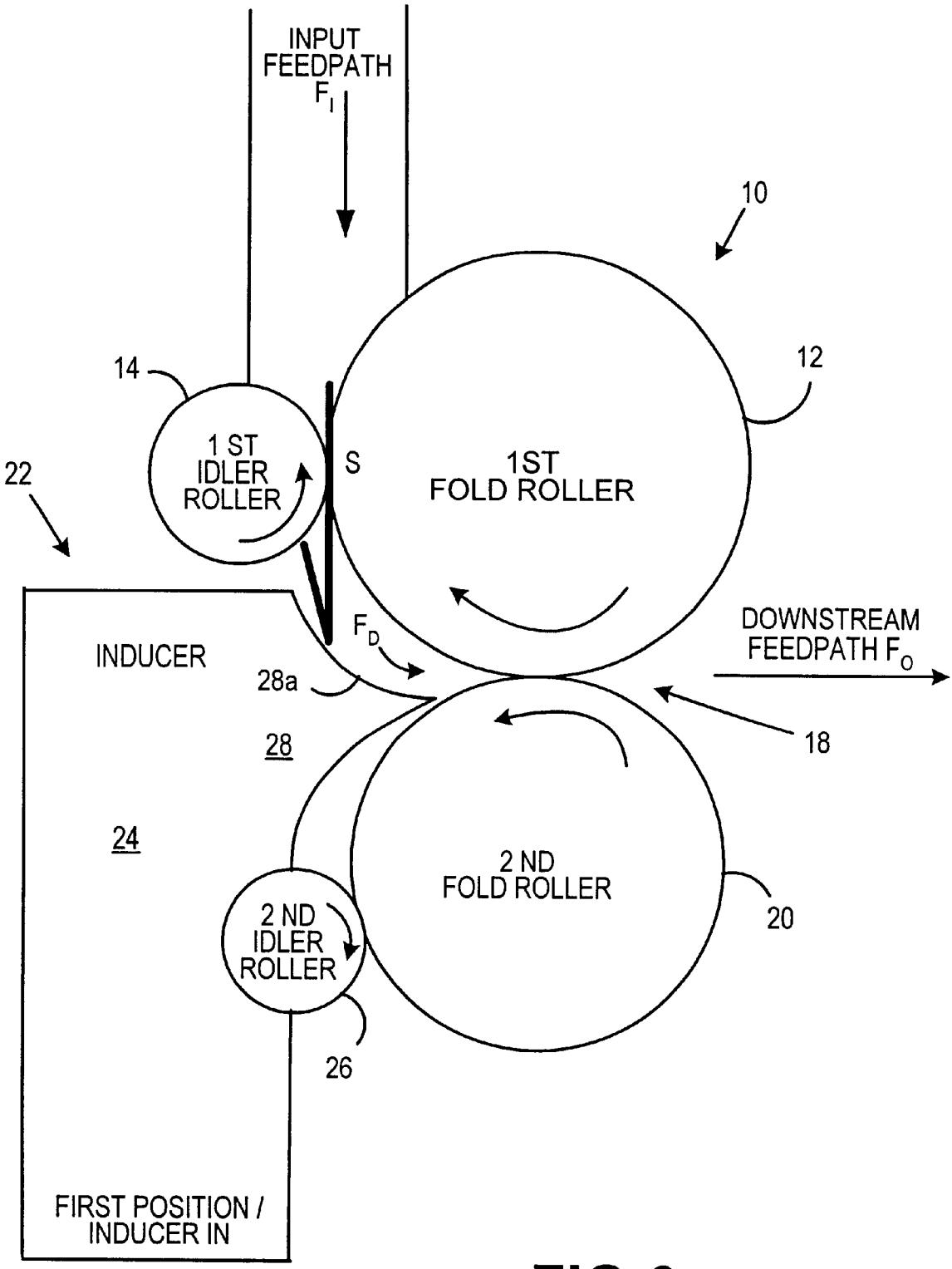
Figure 6D:
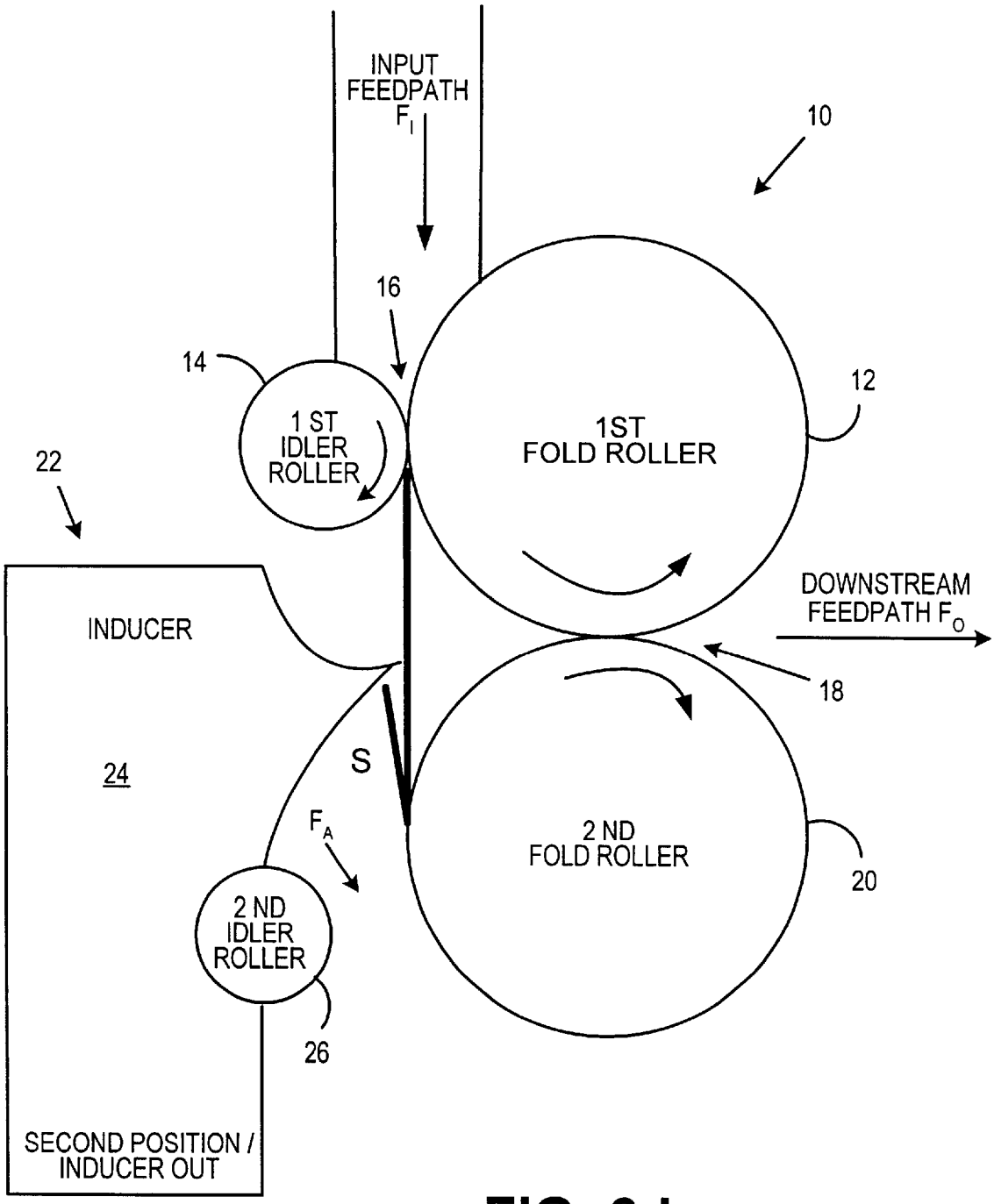
Figure 6E:
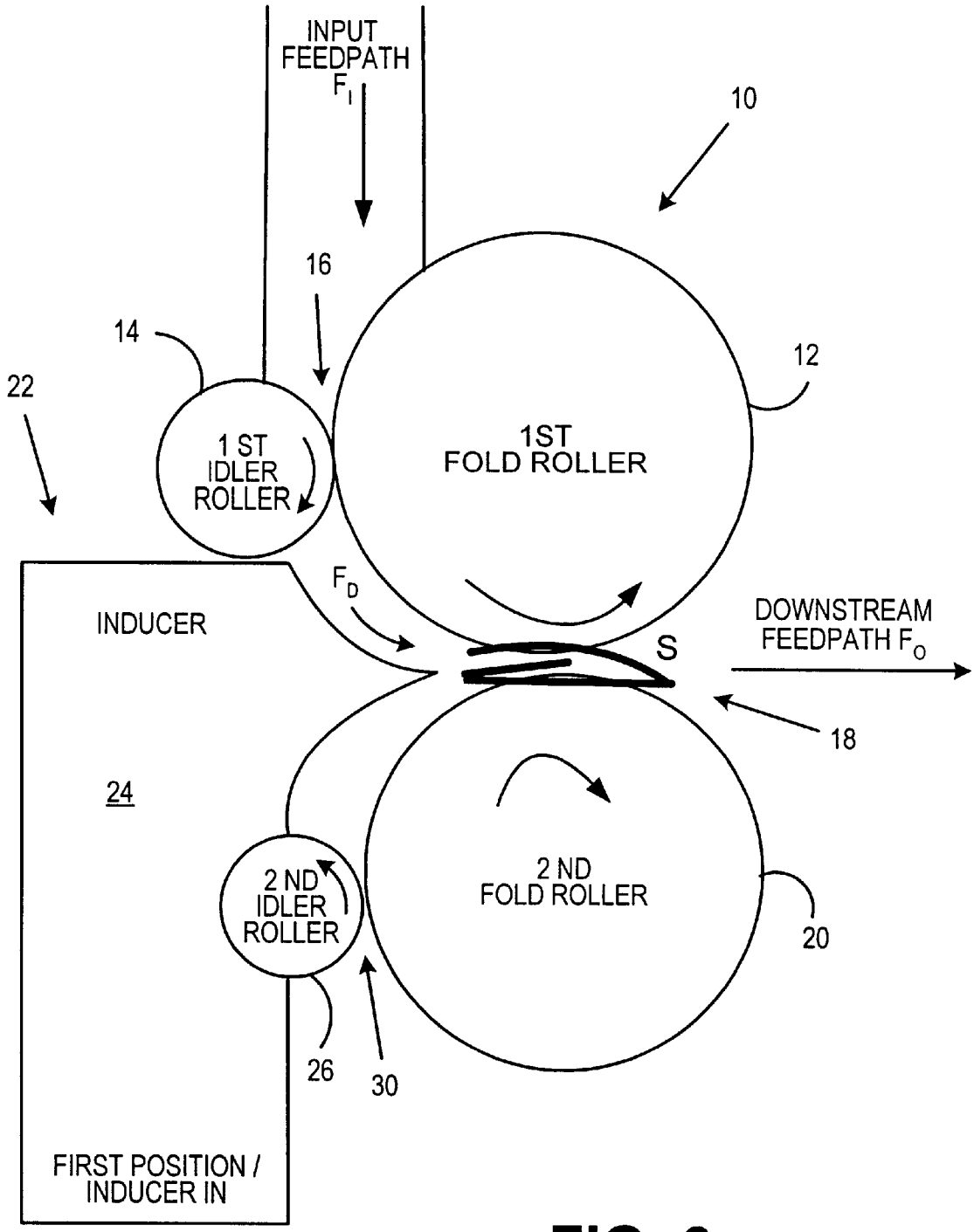

FIGS. 6*a–e* are cross-sectional side views of an embodiment of the present invention illustrating the movement of a sheet through the folder in order to create a C-folded sheet. In FIG. 6*a* the sheet S arrives from input path $F_I$ to nip 16 of rollers 12 and 14 and partially into (about one-third of the sheet) auxiliary feed path $F_A$. In FIG. 6*b*, the inducer is shown in the first position (inducer in) where blade 28 causes a buckle to form in sheet S (at a point approximately one-third the length of the sheet in from the leading edge of the sheet S). Sheet S will next be moved by nip 18 of rollers 12 and 20 to form a fold. Next, as shown in FIG. 6*c*, the motion of rollers 12 and 20 is reversed and the sheet S is moved back along feed path $F_D$ toward feed path $F_I$ and into nip 16 of rollers 12 and 14. Next, as shown in FIG. 6*d*, the inducer is moved to the inducer out or second position opening the passage to auxiliary feed path $F_A$ and the motion of rollers 12, 20 is reversed again and sheet S is to a position where at least a portion (approximately one-third the length of the sheet) of the sheet S is in the auxiliary feed path $F_A$. Next, as shown in FIG. 6*e*, the inducer is moved to the inducer in or first position and the blade 28 causes a another buckle in the sheet S and the sheet S is moved by nip 18 of rollers 12 and 20 to form the second fold. The fold is located at a position on the sheet approximately a third of the way from the trailing edge $S_{TE}$.

The two fold roller, one inducer fold system does not require hard stops or typical buckle chutes to create the fold. As this is the case, the sheet can travel different distances, according to which fold type has been selected by the user. When a different fold type is selected by the user, the system timings are changed to accommodate different sheet lengths and fold types. Also, when C fold or double fold is selected, the fold system becomes reversible to allow the sheet, once folded with the first fold to reposition the sheet for the second fold.

With the folder system capable of not folding a sheet, but transferring the sheet through to the insertion area, the inserter has the capability of inserting flat sheets. This increases functionality of the inserter and makes the inserter more attractive to the customer.

The present invention provides a device to fold sheets. An advantage of the device is that it allows folding to be bypassed. Another additional advantage of the present invention is that it reduces the need for user settings. It further provides the ability to fold sheets into various configurations. While the present invention has been disclosed and described with reference to a single embodiment thereof, it will be apparent, as noted above that variations and modifications may be made therein. It is, thus, intended in the following claims to cover each variation and modification that falls within the true spirit and scope of the present invention.

What is claimed is:

1. A folder apparatus comprising:

a first fold roller and an input idler roller defining a first nip for feeding a sheet along a feed path to a second nip;

a second fold roller positioned adjacent to the first fold roller and defining a second nip there between, the second nip for feeding the sheet along a downstream feed path;

an inducer comprising a movable body repositionable between at least a first and second position, at least one inducer idler roller positioned on the body and in a first position forming a nip between the second fold roller and the at least one inducer idler roller, and a blade positioned adjacent to the at least one inducer idler roller and defining a portion of the feed path adjacent to the first fold roller when the inducer is in the first position;

whereby when the inducer is in a second position an auxiliary feed path is formed and whereby the sheet may travel along the auxiliary feed path and subsequently be buckled by the blade when the inducer returns to the first position.

2. The apparatus as claimed in claim 1 whereby when the inducer is in the first position, a first edge of the blade, deflects the sheet into the feed path defined by the blade and the first fold roller for movement into the second nip.

3. The apparatus as claimed in claim 1 whereby the inducer is movable between the first and second positions by rotation about a first pivotal mounting.

4. The apparatus as claimed in claim 1 whereby the inducer is movable between the first and second positions by linear movement of the frame along a rail and the inducer defines a chamber in which the rail is positioned.

5. A folder apparatus comprising:

a first fold roller and an input idler roller defining a first nip for feeding a sheet along a feed path to a second nip;

a second fold roller positioned adjacent to the first fold roller and defining a second nip there between, the second nip for feeding the sheet along a downstream feed path;

an inducer comprising a movable body repositionable between at least a first and second position, at least one inducer idler roller positioned on the body and in a first position forming a nip between the second fold roller and the at least one inducer idler roller, and a blade positioned adjacent to the at least one inducer idler roller and defining a portion of the feed path adjacent to the first fold roller when the inducer is in the first position; and whereby when the inducer is in a second position an auxiliary feed path is formed and whereby the sheet may travel along the auxiliary feed path and subsequently be buckled by the blade when the inducer returns to the first position; and whereby when the inducer is in the first position, a first edge of the blade, deflects the sheet into the feed path defined by the blade and the first fold roller for movement into the second nip.

6. A folder apparatus comprising:

a first fold means and an input roller means defining a first nip for feeding a sheet along a feed path to a second nip;

a second fold means positioned adjacent to the first roller means and defining a second nip there between, the second nip for feeding the sheet along a downstream feed path;

an means for inducing a fold in the sheet comprising a movable body repositionable between at least a first and second position, at least one idler roller positioned on the body and in a first position forming a nip between the second fold roller means and the at least one inducer idler roller, and a blade positioned adjacent to the at least one inducer idler roller and defining a portion of the feed path adjacent to the first fold roller when the means for inducing a fold in the sheet is in the first position;

whereby when the means for inducing a fold in the sheet is in a second position an auxiliary feed path is formed and whereby the sheet may travel along the auxiliary feed path and subsequently be buckled by the blade when the means for inducing a fold in the sheet returns to the first position.

7. The apparatus as claimed in claim 6 whereby when the means for inducing a fold in the sheet is in the first position, a first edge of the blade, deflects the sheet into the feed path defined by the blade and the first fold means for movement of the sheet into the second nip.

8. The apparatus as claimed in claim 6 whereby the means for inducing a fold in the sheet is movable between the first and second positions by rotation about a first pivotal mounting.

9. The apparatus as claimed in claim 6 whereby the means for inducing a fold in the sheet is movable between the first and second positions by linear movement of the frame along a rail and the means for inducing a fold in the sheet defines a chamber in which the rail is positioned.

* * * * *